United States Patent [19]

Fishler

[11] Patent Number: 4,568,007

[45] Date of Patent: Feb. 4, 1986

[54] REFRACTORY SHROUD FOR CONTINUOUS CASTING

[75] Inventor: Mark K. Fishler, Pittsburgh, Pa.

[73] Assignee: Vesuvius Crucible Company

[21] Appl. No.: 573,295

[22] Filed: Jan. 23, 1984

[51] Int. Cl.[4] ..... B22D 37/00

[52] U.S. Cl. ..... 222/606; 222/591; 164/437

[58] Field of Search ..... 222/591, 606, 607; 164/337, 437

[56] References Cited

U.S. PATENT DOCUMENTS

| | | | |
|---|---|---|---|
| 3,801,083 | 4/1974 | Mantey et al. | 222/591 |
| 4,210,264 | 7/1980 | Kondo | 222/591 |

FOREIGN PATENT DOCUMENTS

| | | | |
|---|---|---|---|
| 0030890 | 8/1974 | Japan | 164/437 |
| 0043712 | 4/1978 | Japan | 222/591 |
| 0054244 | 4/1980 | Japan | 164/437 |
| 1158317 | 7/1969 | United Kingdom | 222/591 |
| 2109099 | 5/1983 | United Kingdom | 222/591 |
| 0235249 | 10/1969 | U.S.S.R. | 222/591 |

OTHER PUBLICATIONS

Okamoto, Kazuma et al., "Development of Alumina--Graphite Immersion Nozzle for Continuous Casting", *Iron and Steel Engineer*, p. 47, Dec. 1982.

*Primary Examiner*—Joseph J. Rolla
*Assistant Examiner*—Louise S. Heim
*Attorney, Agent, or Firm*—Reed Smith Shaw & McClay

[57] ABSTRACT

The present invention provides a refractory tube through which a stream of molten metal is passed during continuous casting which includes an inner refractory member of relatively low thermal expansion and thermal conductivity characteristics and an outer refractory member of high erosion resistance. The cooperation of the inner and outer refractory members results in an end product with a prolonged useful casting life and which does not require preheating prior to use. In a preferred embodiment, the inner refractory member is formed of fused silica and the outer refractory member is formed of alumina graphite and/or zirconia graphite.

6 Claims, 4 Drawing Figures

REFRACTORY SHROUD FOR CONTINUOUS CASTING

FIELD OF THE INVENTION

The present invention relates to refractory articles for use in continuous casting of molten metals, and more particularly, to elongated refractory tubes and shrouds through which a molten metal stream is passed from a ladle to a tundish or from a tundish to a continuous casting machine.

DISCUSSION OF THE TECHNICAL PROBLEM

In the art of continuous casting for progressively forming an elongated billet from a stream of molten metal, it is known to use an elongated refractory tube to control and protect the molten stream. Such refractory tubes may be positioned to surround the molten stream as it passes from ladle to tundish and/or from tundish to continuous casting mold.

In the current state of the art, refractory tubes are commonly made from alumina graphite and/or zirconia graphite refractory materials, or in the alternative from fused silica. Refractory tubes formed of alumina graphite and/or zirconia graphite are highly resistant to erosion from molten steel and the artificial slags commonly used in the casting mold, and accordingly, yield prolonged casting runs without the need for frequent tube changes and corresponding reduction in output and quality. However, such refractory tubes are disadvantageous because they require extensive preheating prior to use to avoid thermal shock, premature cracking and freeze-up of the metal within the tube, e.g., up to about 1800° F. Special handling techniques are required and considerable delays occur during tube changes as a result of the need for preheating.

Refractory tubes formed of fused silica are widely used and do not require such preheating procedures. However, they are disadvantaged by a relatively low erosion resistance to many grades of molten steel and artificial slags, thereby requiring frequent tube changes which adversely affect quality of product, because each tube change necessitates a change in the withdrawal rate of the billet from the continuous casting machine.

It would be advantageous to have a refractory tube for continuous casting which did not require preheating prior to use, yet yielded prolonged casting runs resulting in a higher quality casting product.

SUMMARY OF THE INVENTION

The present invention provides a unique refractory tube which has high erosion resistance to molten steel and artificial slags and which minimizes or eliminates the need for preheating procedures prior to use. Although not limiting to the invention, the refractory tube will be herein described as it is used in continuous casting, where it yields prolonged casting runs. A refractory tube according to the present invention includes a first elongated refractory member formed of a high erosion resistance refractory material and a second elongated refractory member secured within the first member which is formed of a second refractory material having low thermal expansion and low thermal conductivity characteristics relative to the first refractory material. The second refractory member includes a bore through which the stream of molten metal is passed during continuous casting.

At the beginning of use, the inner, second elongated refractory member "shields" the outer, first elongated refractory member from thermal shock which might otherwise occur upon the initial passage of the molten metal stream. The inner, second elongated refractory member also protects against freeze-up of the molten metal stream which might otherwise occur due to the relatively high thermal conductivity of the outer, first elongated member. At the same time, in applications where the refractory tube is partially immersed below the slagline of the mold, the high erosion resistance of the outer, first elongated refractory member protects the inner member from erosion which would otherwise occur where the refractory tube is in contact with the artificial slag of the casting mold.

As casting progresses, the inner, second elongated refractory member erodes away due to contact with the molten metal stream. However, during this erosion period the outer, first elongated refractory member is gradually heated to operating temperature so that it can thereafter function for prolonged casting runs in direct contact with the molten metal stream without suffering thermal shock or causing freeze-up of the molten metal stream.

DESCRIPTION OF PREFERRED EMBODIMENTS

Figure 1:
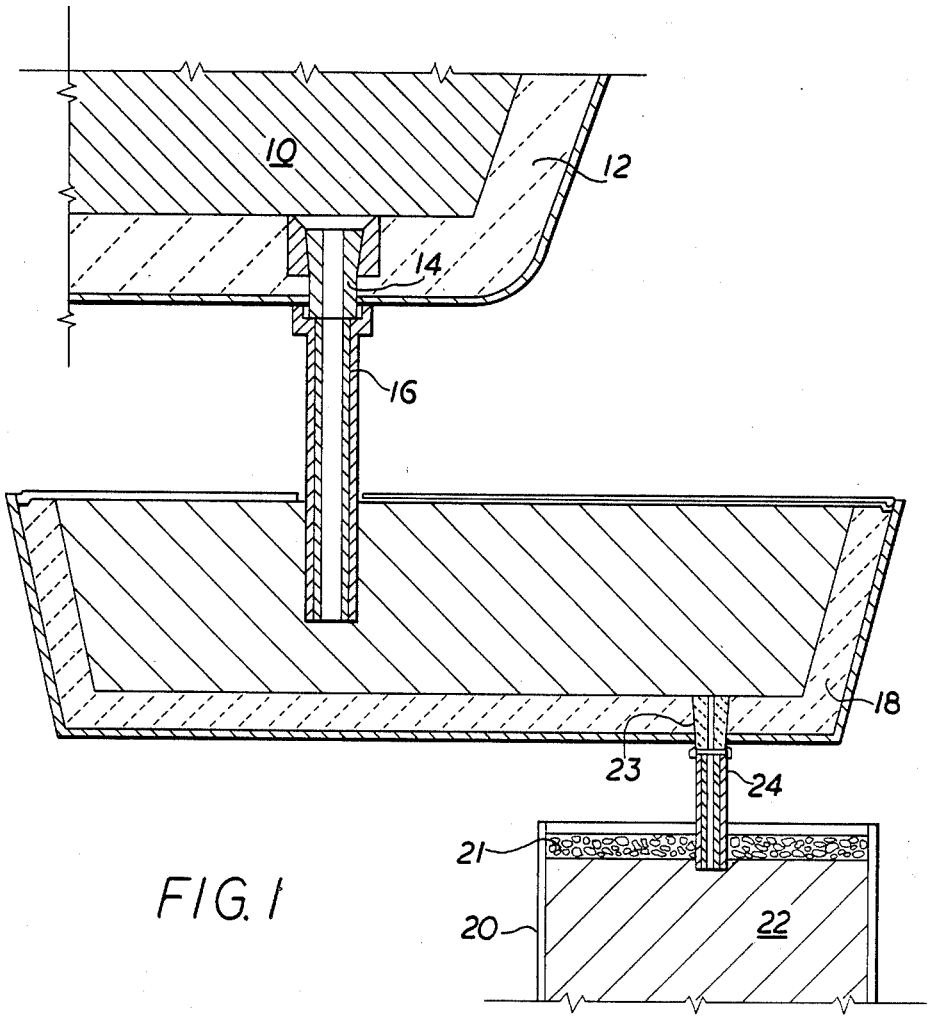
FIG. 1 is a partially schematic, elevated cross-sectional side view of a continuous casting facility incorporating features of the present invention.

With reference to FIG. 1, a continuous casting steel making operation includes a supply 10 of molten steel contained within a refractory-lined ladle 12. Molten steel is teemed from the ladle 12 through a nozzle 14 and a shroud 16 into a tundish 18. The molten steel in the tundish 18 is then delivered into a continuous casting mold 20, preferably through a layer of artificial slag 21 to a level below the upper surface of the molten metal 22 therein, through a nozzle 23 and a shroud 24 of the subentry variety.

On introduction into the continuous casting mold 20, the molten metal begins to solidify as it flows through the casting mold 20, with the outer portions of the molten metal solidifying first to form a shell. The molten metal adjacent the interior of the casting mold 20 is retained within this outer shell even after the metal exits from the casting mold 20 until such time as it cools to a completely solid form. Thus, control over the rate at which the process occurs is critical to achieving a satisfactory result.

During a prolonged casting sequence, conventional shrouds regularly must be replaced due to erosion by the molten metal stream, with each shroud change detrimentally affecting the quality of the billet being produced. Shrouds of a conventional fused silica composition generally have a useful casting life of about one hour.

Shrouds of alumina graphite compositions and/or zirconia graphite compositions generally have greater erosion resistance and substantially longer useful casting lives, e.g., up to about four times a fused silica useful life, and accordingly may yield higher quality output from the casting procedure. However, such alumina graphite and zirconia graphite shrouds have relatively high thermal conductivity and thermal expansion characteristics and must be preheated to near their operating temperatures in a prolonged and controlled manner prior to use. Failure to properly preheat results in premature cracking and failure and/or freeze-up of the molten metal stream, causing additional production delay and adversely affecting billet quality. Specialized handling techniques are necessary to replace an exhausted shroud with a preheated replacement shroud.

As used herein, alumina graphite is considered any refractory body or body portion containing 35–70% alumina, 20–40% carbon (crystalline graphite and amorphous), and 5–29% $SiO_2$. Although not limiting to the invention, the body or body portion may contain antioxidants and glass-formers such as SiC, Si, CaO, $Na_2O$, $B_2O_3$, etc. in varying proportions.

As used herein, zirconia graphite is considered any refractory body or body portion containing 50–85% zirconia and 10–30% total carbon (crystalline graphite and amorphous). Although not limiting to the invention, the balance of the body may be made up of antioxidants or glass-formers such as SiC, Si, $SiO_2$, CaO, $Al_2O_3$, etc. in varying proportions.

Figure 2:
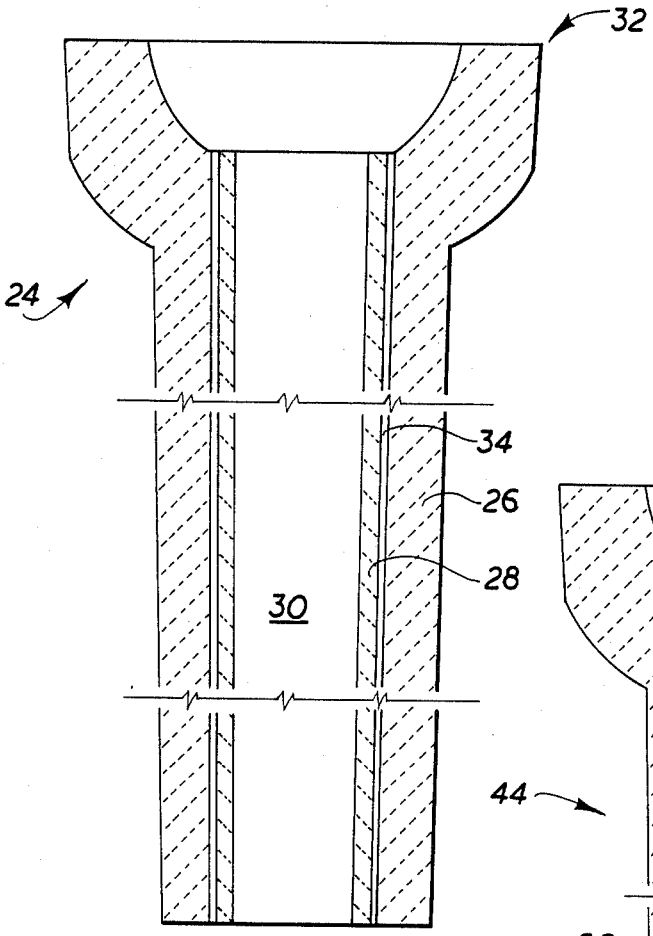
FIG. 2 is an elevated, cross-sectional side view of a refractory tube incorporating features of the present invention.

With reference to FIG. 1 and FIG. 2, a shroud 24 in accordance with a first embodiment of the present invention is shown. Shroud 24 includes an outer elongated refractory tube member 26, into which is positioned and secured an inner elongated refractory tube member 28. Second tube member 28 includes a generally central inner bore 30 through which a stream of molten metal may be passed during a casting operation. Shroud 24 is conveniently configured at its upper or inlet end 32 to be secured in any convenient manner to nozzle 23.

Outer tube member 26 is formed of a refractory composition different from the refractory composition of inner tube member 28. Outer tube member 26 could be formed separately from inner tube member 28, or tube members 26 and 28 could be formed integrally in a single procedure. Where formed separately, outer tube member 26 would generally be formed by isostatic pressing. The inner tube member 28 could be formed by slip casting, injection moldings, vacuum casting, thixotropic casting or other techniques known in the art. Each member could be processed independently, i.e., dried and fired, and then be joined by a suitable refractory cement to form an integral refractory body.

It is also preferred that the inner bore of outer tube member 26 and the outer surface of inner tube member 28 be complimentarily tapered from top to bottom for an interfitting relationship which prevents inner tube member 28 from moving downwardly in outer tube member 26 after they are secured together.

Inner tube member 28 is preferably formed of a refractory composition exhibiting relatively low thermal conductivity and thermal expansion characteristics, e.g., thermal conductivity between about 0.20 Btu/ft.$^2$ hr. °F. ft. in the general temperature range between 500° F. and 2000° F. and 0.90 Btu/ft.$^2$ hr. °F. ft. in the general temperature range between 500° F. and 2000° F. and thermal expansion between about 0.015% and 0.20% in the temperature range from ambient to 1500° F. In a preferred embodiment of the invention for use in highly erosive molten metal streams, fused silica is processed in a known manner into a proper shape for use as inner tube member 28, although for other applications such refractory materials as fused silica/zirconia or fire clay could be advantgeously utilized.

Outer tube member 26 is preferably formed of a refractory composition exhibiting relatively high erosion resistance and commonly will be a graphite containing material. In one preferred embodiment of the invention, outer tube member 26 may be formed in a known manner of materials selected from the group of alumina graphite, zirconia graphite, magnesite graphite, or clay graphite or combinations thereof.

Although not limiting to the invention, inner tube member 28 is generally formed with a thickness up to about one third of the total thickness of shroud 24, and in any event with a thickness at least sufficient to reduce the temperature to which shroud 24 must be preheated prior to use. When used with commonly used continuous casting machines where the total thickness of shroud 24 is limited by physical clearances of the apparatus, inner tube member 28 is generally formed with a thickness between about 5 mm. and and about 15 mm.

Figure 3:
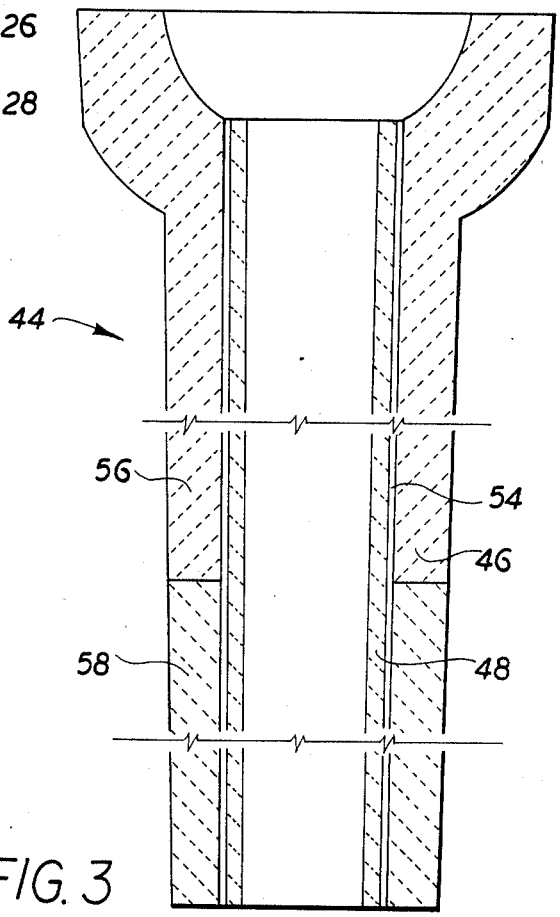
FIG. 3 is a view similar to the view of FIG. 2, illustrating a second embodiment of a refractory tube incorporating features of the present invention.

With reference to FIG. 3, a second embodiment of the invention is shown in which a shroud 44 is conveniently formed of an outer elongated refractory tube member 46, an inner elongated refractory tube member 48, and an intermediate layer of refractory cement 54 therebetween. As in FIG. 2, inner tube member 48 extends along substantially all of the length of the outer tube member 46. Unlike FIG. 2, outer tube member 46 includes an upper portion 56 and a lower portion 58, each being formed of a different refractory composition. In one highly preferred embodiment of the invention, upper portion 56 is formed of alumina graphite while lower portion 58 is formed of zirconia graphite for use in direct contact with the artificial slag 21 of the casting procedure. Upper portion 56 and lower portion 58 may be formed independently and cemented together in a known manner, or alternatively, the composite outer tube member 46 may be formed in a single procedure in a known manner.

Figure 4:
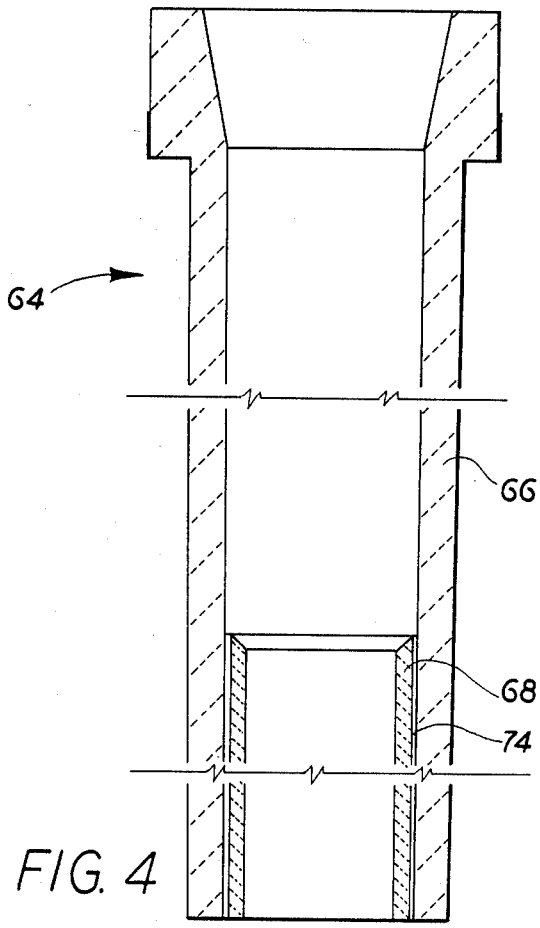
FIG. 4 is a view similar to the view of FIG. 2, illustrating a third embodiment of a refractory tube incorporating features of the present invention.

With reference to FIG. 4, a third embodiment of the invention is shown in which a shroud 64 is conveniently formed of an outer elongated refractory tube member 66, an inner, less-elongated refractory tube member 68, and an intermediate layer of refractory cement 74 therebetween. Although not limiting to the invention, inner tube member 68 is preferably positioned adjacent to the bottom, outlet end of outer tube member 66, where generally conditions are most severe.

In operation, the shroud according to the present invention exhibits a superior erosion resistance for a prolonged useful life and superior billet quality, while at the same time minimizing or eliminating the need for time consuming and inconvenient preheating procedures previously required with extended life refractory tubes.

Although perhaps not fully understood, it is believed that the two component parts of the shroud 24 uniquely complement and cooperate with one another to yield the advantageous results of the present invention. The inner tube member 28 shields and insulates the more temperature-sensitive outer tube member 26 from thermal shock and cracking which would otherwise occur, absent preheating, when the molten metal stream first begins to pass therethrough. Indeed, it is believed that inner tube number 28 serves to strenghten outer tube number 26 from cracking by causing the exterior portions of outer tube number 26 to expand more rapidly than interior portions thereof, thereby placing outer tube member 26 in a compressive state. Inner tube member 28 also protects against a freeze-up of the molten stream which would otherwise occur, by interposing a low thermal conductivity barrier between the molten metal stream and the relatively high thermal conductivity outer tube member 26.

In addition, outer tube member 26 protects inner tube member 28 by providing a resistive physical barrier between the highly erosive artificial slag 21 of the casting mold and the outer surface of inner tube member 28, thereby protecting the area where erosion would be greatest in a conventional fused silica refractory tube.

During casting, inner tube member 28 gradually erodes away due to direct contact with the molten metal stream, and gradually permits the outer tube member 26 to heat up to uniform operating temperature while in operation. Thereafter and for the remainder of the casting sequence shroud 24 functions as a conventional alumina graphite and/or zirconia graphite shroud to yield a prolonged useful casting life and high quality output.

EXAMPLE

Twelve shrouds 44 of the type shown in FIG. 3 were produced, each having an alumina graphite upper portion and a zirconia graphite lower portion in an outer tube member 46 with thickness of about 18.5 mm. Inner tube member 48 was formed of fused silica with a thickness of 9.5 mm. and was cemented within the slightly tapered bore of outer tube member 46.

The shrouds 44 were designed for use with a six strand billet caster which generally used all-fused silica refractory tubes which required no preheat treatment prior to use but which were generally kept in a drying oven to prevent moisture absorption. Such tubes had a useful life of about one hour, thus requiring three or more tube changes per strand per casting sequence.

The initial shroud 44 to be tested was preheated partially to about 600° C. before being placed into service for the last thirty minutes of a casting sequence. No cracking or freeze-up of the molten stream was encountered and physical examination of the piece after use showed it to be in a superior condition.

Based upon these results, the remaining eleven shrouds 44 were utilized at the start up of a new casting sequence or at the time of the initial tube change. No preheating of the shrouds was done, but the shrouds were maintained in a conventional drying environment prior to use to minimize moisture absorption by the fused silica of inner tube member 48. (Excessive moisture absorption followed by extreme temperature increases is known to lead to cracking of fused silica articles.) During use, none of the shrouds according to the present invention experienced thermal shock or freeze-up, and the average erosion rate at the level of the artifical slag (where erosion was greatest) was about 0.04 mm. per minute, giving a projected useful life of about four hours for each shroud. These results represent a substantial advancement over known prior art shrouds, which either yield a comparable useful life but require preheating, or have substantially shorter useful lives without preheating.

Of course, it will be appreciated that the present invention is not limited to the specific preferred embodiments discussed above. For example, with reference to FIG. 1, shroud 16 between ladle 12 and tundish 18 can be formed of an inner elongated refractory member and an outer elongated refractory member in accordance with the teachings of the present invention. Accordingly, reference to the appended claims should be made to ascertain the intended scope of the invention.

I claim:

1. A refractory tube for use in controlling and protecting the flow of a stream of molten metal comprising:

an outer elongated refractory member having a first bore therethrough, said outer elongated member formed of a relatively high erosion resistance refractory material selected from one of alumina graphite zirconia graphite, magnesite graphite, clay graphite, and combinations thereof capable of withstanding exposure to said molten metal stream for relatively extended time periods; and an inner elongated refractory member positioned within said first bore of said outer refractory member, said inner elongated refractory member having a second bore through which said stream of molten metal may pass, said inner refractory member formed of a second and different refractory material than said outer refractory member selected from one of fused silica fused silica/zirconia, fire clay, and combinations thereof said second refractory material having low thermal expansion and low thermal conductivity characteristics relative to said first refractory material, said characteristics comprising expansion in the range of between 0.015% and 0.20% in the temperature range from ambient to 1500° F. and conductivity in the range between 0.2 and 0.9 btu/ft.$^2$ hr. °F. ft. in the range between 500° F. and 2000° F.

2. The refractory tube as set forth in claim 1, wherein said inner elongated refractory member is secured within said first bore of said outer elongated refractory member by a refractory cement.

3. The refractory tube as set forth in claim 1, wherein said outer elongated refractory member includes a first end portion adjacent the entry end of said second bore and a second and opposite end portion adjacent the exit end of said second bore, wherein said first end portion is formed with refractory characteristics differing from the refractory characteristics of said second end portion.

4. The refractory tube as set forth in claim 3, wherein said first end portion is formed of an alumina graphite refractory composition, and wherein said second end portion is formed of a zirconia graphite refractory composition.

5. The refractory tube as set forth in claim 1, wherein said inner refractory member is positioned along selected portions of said first bore.

6. The refractory tube as set forth in claim 1, wherein said outer refractory member comprises a combination of a metal oxide and graphite, which if utilized alone, would require preheating to an elevated temperature before use to avoid thermal shock or molten metal freeze-up, and wherein said inner refractory member is formed with a thickness between 5 mm. and 15 mm. which is sufficient to substantially reduce said elevated temperature.

* * * * *